US007199337B2

(12) United States Patent
Torisawa

(10) Patent No.: US 7,199,337 B2
(45) Date of Patent: Apr. 3, 2007

(54) HEATING PLATE AND PROCESS FOR PRODUCING THE SAME

(75) Inventor: Nobuyuki Torisawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 67 days.

(21) Appl. No.: 11/053,939

(22) Filed: Feb. 10, 2005

(65) Prior Publication Data

US 2005/0189339 A1 Sep. 1, 2005

(30) Foreign Application Priority Data

Feb. 27, 2004 (JP) ..... P.2004-053090

(51) Int. Cl.
*H05B 3/44* (2006.01)
*H05B 3/02* (2006.01)

(52) U.S. Cl. ..... 219/544; 219/546

(58) Field of Classification Search ..... 219/216, 219/243, 544, 469–471, 534, 535, 540, 546–548; 118/60; 392/485–496
See application file for complete search history.

(56) References Cited

U.S. PATENT DOCUMENTS 6,147,334 A * 11/2000 Hannigan ..... 219/544

FOREIGN PATENT DOCUMENTS

JP 58-154378 U 10/1983

* cited by examiner

*Primary Examiner*—Sang Y. Paik
(74) *Attorney, Agent, or Firm*—Sughrue Mion, PLLC

(57) ABSTRACT

A heating plate provided with: a heating member; and a guide member, one surface of which comes into contact with the heating member and the other surface of which comes into contact with a body to be heated to heat the body to be heated, wherein plural grooves are provided at prescribed intervals on the one surface of the guide member, and a heat pipe is accommodated in the groove.

5 Claims, 9 Drawing Sheets

HEATING PLATE AND PROCESS FOR PRODUCING THE SAME

This application is based on Japanese Patent application JP 2004-053090, filed Feb. 27, 2004, the entire content of which is hereby incorporated by reference.

BACKGROUND OF THE INVENTION

1. Technical Field of the Invention

The present invention relates to a heating plate for heating a body to be heated and to a process for producing the same.

2. Description of the Related Art

Soaking heating plates to be used for making the temperature distribution, in the widthwise direction in, for example, a fixing roll in an electronic copying machine, uniform have hitherto been disclosed (for example, see JP-UM-A-58-154378 (FIG. 1)).

In one example shown in FIG. 12, a heating plate 1 has a metal plate 2 having, for example, a rectangular cross-sectional shape and made of aluminum, etc., and plural communicating holes 3 are bored in parallel to a front surface 2*b* or a rear surface 2*c* from a side surface 2*a* of the metal plate 2. In each of the communicating holes 3, a capillary structure (wick) 4 is inserted into the communicating hole 3 while making the internal surface of the communicating hole 3 work as a pipe, and a non-illustrated working fluid is vacuum charged in the wick 4, thereby forming a so-called heat pipe.

Accordingly, if a portion where a temperature difference is caused in heating the metal plate 2 is present, in the portion where the temperature is high, the heat pipe is heated to vaporize the working fluid, whereby the heat is absorbed to lower the temperature (absorption of latent heat of vaporization), and the vapor moves into the low-temperature portion. In the portion where the temperature is low, the working fluid which has become a vapor is condensed to release the heat, whereby the temperature is increased (release of latent heat of vaporization), and the condensed working fluid moves into the high-temperature portion due to a capillary phenomenon of the wick 4. That is, the vapor whose temperature has become high passes in the central portion of the communicating hole 3 and moves into the low-temperature portion, and the working fluid which has been condensed by releasing the temperature moves into the high-temperature portion along the internal surface of the communicating hole 3. By repeating this cycle, the temperature of the whole of the metal plate 2 is made uniform, thereby achieving heating.

Now, in an image forming device called as a medical imager, which is used in recent years, a print of a visible image is prepared from an image measured by medical instruments such as CT and MRI. In such an image forming device, a photosensitive heat development recording material (hereinafter also referred to as "heat development recording material") comprising a support (for example, a PET film) having a photosensitive heat development image forming layer formed thereon is used, and a latent image is formed by exposing this heat development recording material with light beams modulated according to image data supplied from an image data supply source (modality) such as MRI. Thereafter, the exposed heat development recording material is thermally developed by a built-in heat development device to cause color development, thereby outputting it as a hard copy. In this case, in order to obtain a stable image, a heating unit capable of uniformly heating the heat development recording material is necessary.

So far, in the heat development device, for the purpose of making the guide surface of a heating section with which the heat development recording material comes into contact uniform, the heat control is carried out while accurately controlling plural heaters, and therefore, this complicated control resulted in an increase in costs. Also, for the sake of absorbing a difference of the heat generation of the plural heaters, it is necessary to increase the heat capacity of the guide itself, and therefore, a heating section was constructed of a metal plate having a thick wall. For this reason, it was difficult to shorten the rise time until the temperature reaches a prescribed development temperature, leading to an obstacle to shortening of the development time.

Then, it may be considered to use the heating plate 1 having soaking properties as disclosed in JP-UM-A-58-154378 (see FIG. 12).

However, in the foregoing heating plate 1, it is necessary to bore plural communicating holes 3 in parallel to the front surface 2*b* or the rear surface 2*c* from the side surface 2*a* of the metal plate 2, and there was encountered such a problem that the processing is difficult, resulting in an increase in costs. Further, there is a disadvantage that the processing precision becomes severe for inserting the wick 4 into the communicating hole 3. Also, although it is possible to form a heating plate having soaking properties by inserting an existing heat pipe into the communicating hole 3, the heat pipe must be brought into intimate contact with the inside of the communicating hole 3. Thus, this case also involved such inconveniences that high processing precision is required in boring processing and that the processing is difficult.

SUMMARY OF THE INVENTION

An object of the invention is to provide a heating plate which can be easily produced at low costs while enhancing a heat transfer effect and a soaking effect ("soaking" as used herein indicates a property that uniforms the temperature within a plate surface), and a process for producing the same, thereby realizing uniform heating of a body to be heated.

In order to achieve the foregoing object, the heating plate and the process for producing the same has the following constitution.

(1) A heating plate provided with a heating member and a guide member, one surface of which comes into contact with the heating member and the other surface of which comes into contact with a body to be heated to heat the body to be heated, wherein plural grooves are provided at prescribed intervals on the one surface of the guide member, and a heat pipe is accommodated in each groove.

According to this heating plate, a heating member causes heat generation and heats a guide member made of a metal plate, one surface of which comes into contact with the heating member. Plural grooves are provided on the one surface of the guide member, and a heat pipe is accommodated in the groove. In this way, the temperature of the guide member heated by the heating member is made uniform, and a body to be heated, which comes into contact with the other surface of the guide member, is uniformly heated, whereby stable development can be achieved. At this time, since the heat pipe is accommodated in the groove provided on the one surface of the guide member, the processing can be easily carried out as compared with the related-art case where communicating holes are provided from the side surface of a metal plate for constructing or inserting heat pipes.

(2) The heating plate according to (1), wherein the groove of the guide member is formed so as to have a size smaller than the outer diameter of the heat pipe before the accommodation.

According to this heating plate, since the size of the groove provided in the guide member is smaller than the outer diameter of the heat pipe before the accommodation, the heat pipe causes deformation to come into intimate contact with the internal surface of the groove. In this way, since the heat transfer between the heat pipe and the guide member is smoothly carried out, it is possible to make the temperature of the guide member uniform as a whole.

(3) The heating plate according to 1, wherein the heating member is a rubber plate having a heating element inside a silicone rubber.

According to this heating plate, since the heating member is a rubber plate having a heating element therein, the heating member and the guide member can be easily brought into intimate contact with each other, and the guide member can be heated with good efficiency. Also, even in the case where a top of the heat pipe accommodated in the groove is protruded from the one surface of the guide member, since the rubber heater is easily deformed, it is possible to accommodate the heat pipe in the groove. Accordingly, even when the processing precision of the groove is lowered to some extent, there is no obstacle, and the processability becomes good.

(4) The heating plate according to (1), wherein a copper tube is accommodated in at least one of the grooves of the guide member in place of the heat pipe.

According to this heating plate, by accommodating heat pipes of the number necessary for making the temperature of the guide member uniform in the grooves and aligning copper tubes in other grooves, it is possible to shorten the time for temperature rise while making the heat capacity of the guide member small and ensuring the heat transfer properties by the alignment of copper tubes.

(5) A process for producing a heating plate provided with a heating member and a guide member, one surface of which comes into contact with the heating member and the other surface of which comes into contact with a body to be heated to heat the body to be heated, which comprises forming plural grooves on the one surface of the guide member, and press fitting a heat pipe having a diameter larger than the width of the groove into the groove, thereby bringing the external periphery of the heat pipe into intimate contact with the surface of the groove.

According to this process for producing a heating plate, plural grooves are provided on one surface of a guide member made of, for example, an aluminum metal plate, which comes into contact with a heating member, a heat pipe having an outer diameter before the accommodation larger than the width of the groove is press fitted into the groove, and the heat pipe is put between the guide member and the heating member, thereby producing a heating plate. In this way, in the guide member, it is not necessary to provide a communicating hole along the front surface or the rear surface from the side surface as seen in the related art, and the grooves are provided on the one surface, and therefore, the processing can be easily carried out. Also, when a heat pipe having a diameter slightly larger than the width of the groove is press fitted into the groove, since a copper-made heat pipe is deformed along the internal surface of the groove, it is possible to surely bring the heat pipe into intimate contact with the internal surface of the groove, and it is possible to subject the guide member to soaking with good efficiency.

(6) A process for producing a heating plate provided with a heating member and a guide member, one surface of which comes into contact with the heating member and the other surface of which comes into contact with a body to be heated to heat the body to be heated, which comprises forming plural grooves on the one surface of the guide member, accommodating a heat pipe in the groove, placing a silicone rubber before vulcanization having a heating element inside the silicone rubber on the one surface of the guide member, and vulcanizing for welding the silicone rubber while pressing it onto the guide member.

According to this process for producing a heating plate, plural grooves are provided on one surface of a guide member made of, for example, an aluminum metal plate, which comes into contact with a heating member, a heat pipe is accommodated in the groove, and a silicone rubber before vulcanization having, for example, a heating element in the sandwiched form is pressed onto the heat pipe and heated under pressure. In this way, the silicone rubber is vulcanized to become in the rubber state and permeates between the surface of the groove and the heat pipe, whereby the groove and the heat pipe are brought into intimate contact with each other. Thus, no gap is formed between the heat pipe and the surface of the groove, whereby the heat transfer properties are enhanced. Also, since it is not necessary to provide a communicating hole in the guide member, it is possible to produce a heating plate while designing to reduce costs.

According to the invention, it is not necessary to bore communicating holes from the side surface of a metal plate as seen in the related art, but grooves are provided on one surface. Thus, not only a heating plate can be easily produced at low costs with largely improved processability, but also uniform heating of a body to be heated can be realized with enhanced heat transfer effect and soaking effect.

DETAILED DESCRIPTION OF THE INVENTION

Preferred embodiments of the heating plate and the process of producing the same according to the invention will be described below in detail with reference to the drawings.

Figure 1:
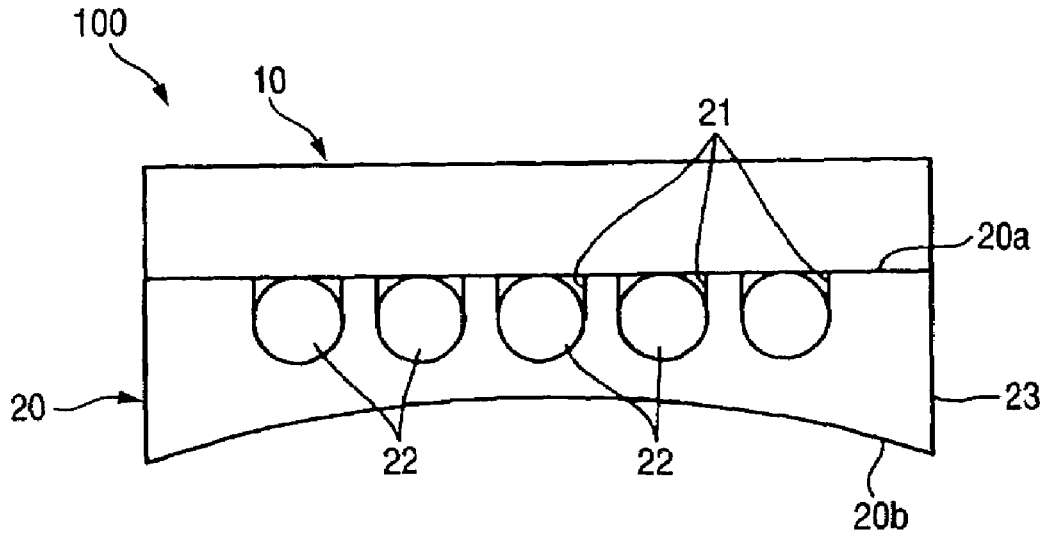
FIG. 1 is a side view to show the first embodiment of the heating plate and the process for producing the same according to the invention.
Figure 2:
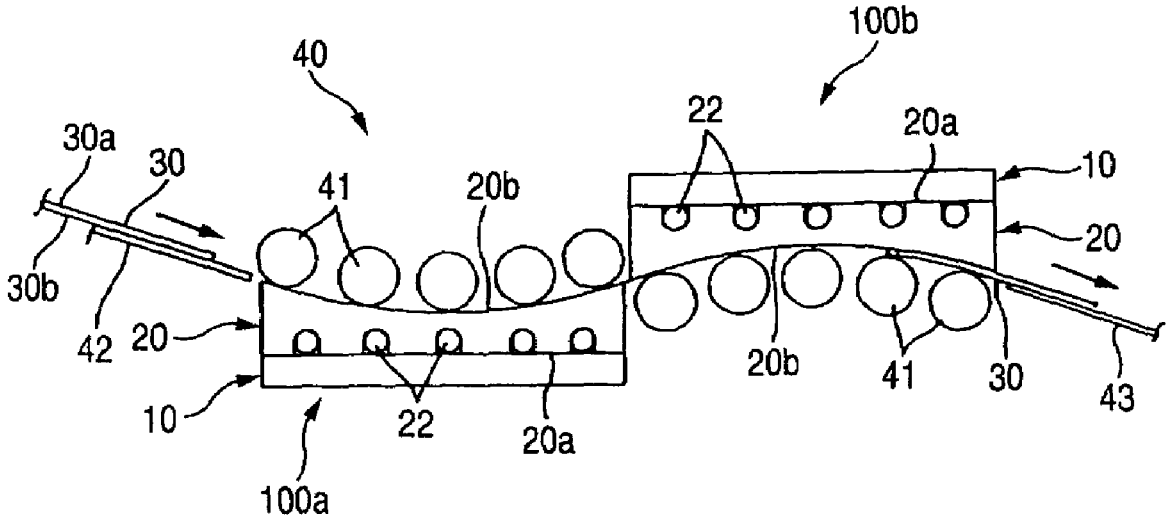
FIG. 2 is a side view to show an application example for heating the both surfaces of a heat development recording material while arranging heating plates.

FIG. 1 is a side view to show the first embodiment according to the heating plate and the process of producing the same of the invention; and FIG. 2 is a side view to show an application example for heating the both surfaces of a heat development recording material while arranging heating plates.

As illustrated in FIG. 1, a heating plate 100 as one embodiment of the invention is provided with a heating member 10 and a guide member 20; one surface 20*a* of the guide member 20 is heated by the heating plate 10; and a heat development recording material 30 (see FIG. 2) as a body to be heated is heated while making the other surface 20*b* of the guide member 20 work as a heating surface.

Figure 5:
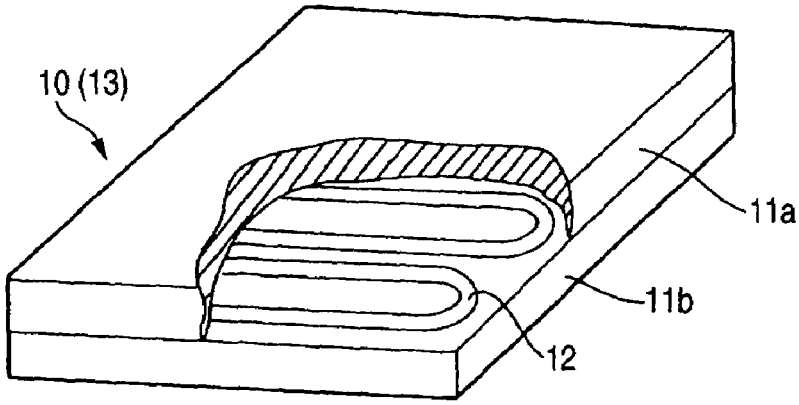
FIG. 5 is a partial cross-sectional perspective view of a rubber heater.

As the heating member 10, a rubber heater as illustrated in FIG. 5 as described later can be used. However, any kind of heating elements can be utilized so far as they fall within the gist of the invention.

As illustrated in FIG. 1, the guide member 20 is made of, for example, a metal plate of aluminum having high heat conductivity, and the one surface 20*a* of the guide member 20 comes into contact with the heating member 10. Also, the other surface 20*b* of the guide member 20 comes into contact with the heat development recording material 30 and heats it, thereby achieving development. Incidentally, though the other surface 20*b* of the guide member 20 is curved in the arc shape in the illustrative example so as to surely come into contact with the heat development recording material 30, it may be in the planar shape.

Plural grooves 21 having a U-shaped cross-section and the like are provided at prescribed intervals on the one surface 20*a* of the guide member 20, and a heat pipe 22 is accommodated in each groove. It is suitable that the cross-sectional area of the groove 21 is approximately equal to that of the heat pipe 22. The heat pipe 22 is one in which a capillary structure (wick) is formed on the internal surface of a copper-made pipe, and a working fluid is vacuum charged therein. The heat pipe 22 makes the temperature distribution of the whole of the guide member uniform by the movement of a vapor resulting from vaporization of the working fluid and the condensed working fluid.

Accordingly, even in the case where the one surface 20*a* of the guide member 20 is not uniformly heated by the heating member 10, the temperature distribution on the other surface 20*b* as a heating surface is made uniform.

FIG. 2 is a schematic view of one example of a heating section 40 of a heat development device for heating the heat development recording material 30 having an image forming layer formed on both an upper surface 30*a* and a lower surface 30*b* thereof using the heating plate 100 illustrated in FIG. 1. In the heating section 40, two heating plates 100*a*, 100*b* are aligned in the opposite direction to each other such that the front and rear surfaces of the heat development recording material 30 are alternately heated. Plural press rolls 41 are aligned along the heating surface 20*b* in the guide member 20 of each of the heating plates 100*a*, 100*b*. A gap smaller than the thickness of the heat development recording material 30 is provided between the press roll 41 and the heating surface 20*b* of the guide member 20, and each press roll 41 ensures the gap and is energized toward the heating surface 20*b* of the guide member 20 by a spring, etc. At the same time, each press roll 41 is rotated and driven by a non-illustrated drive unit.

Accordingly, the heat development recording material 30 fed into the first heating plate 100*a* from a feed tray 42 is delivered by the rotation of the press rolls 41 while the upper surface 30*a* is pressed on the heating surface 20*b* due to an energizing force of the press rolls 41 to be rotated and driven and then fed into the second heating plate 100*b*. The heat development recording material 30 fed into the second heating plate 100*b* is delivered while the lower surface 30*b* is pressed on the heating surface by the press rolls 41 to be rotated and driven in the same manner, and the heat development recording material 30, both the upper and lower surfaces 30*a*, 30*b* of which haven been heated, is discharged from a discharge tray 43.

Next, the process of producing a heating plate having the foregoing construction will be described below with reference to FIG. 3A to FIG. 3E.

Figure 3A:
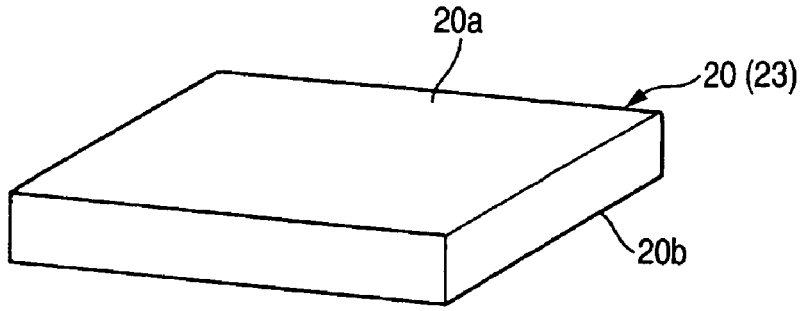
FIGS. 3A to 3E are explanatory views to show the process for producing a heating plate according to the invention.
Figure 3B:
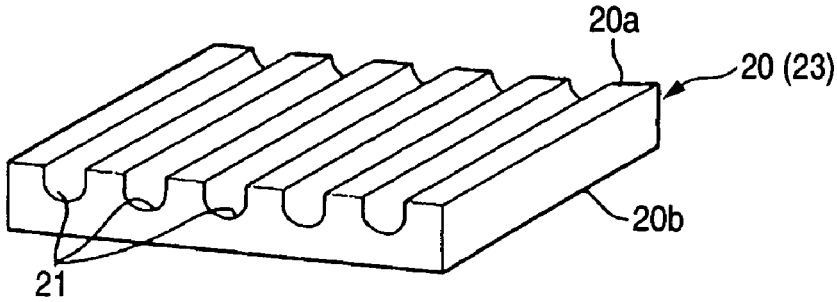

FIG. 3A to FIG. 3E are each an explanatory view to show the process of producing a heating plate according to the invention; FIG. 4A is a cross-sectional view to show the state before the heat pipe is press fitted into the groove; and FIG. 4B is a cross-sectional view to show the heat pipe having been press fitted into the groove.

First of all, the production of the guide member 20 is carried out. As illustrated in FIG. 3A, a solid aluminum metal plate 23 is prepared; and as illustrated in FIG. 3B, the plural grooves 21 are provided at prescribed intervals on the one surface 20*a* of the metal plate 23. In this case, the formation of the grooves 21 can be very easily carried out as compared with the related-art processing in which communication holes are bored in the transverse direction from the side surface of the metal plate. At this time, as illustrated in FIG. 4A, the groove 21 is formed such that its width 21 is, for example, approximately 5/100 mm smaller than an outer diameter D of the heat pipe 22 before it is accommodated in the groove 21.

Figure 3C:
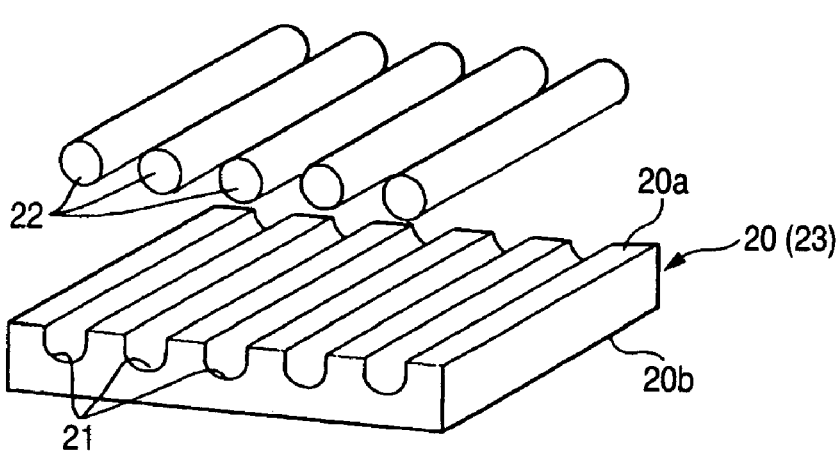
Figure 3D:
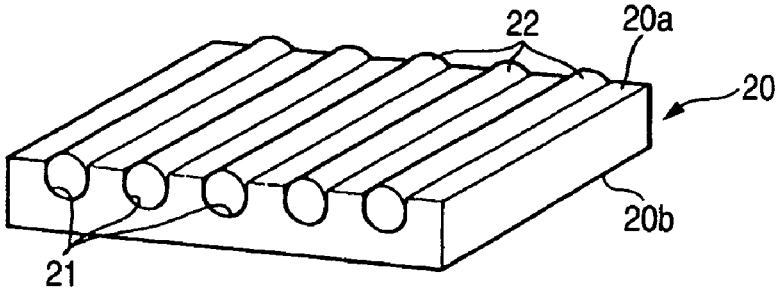
Figure 4A:
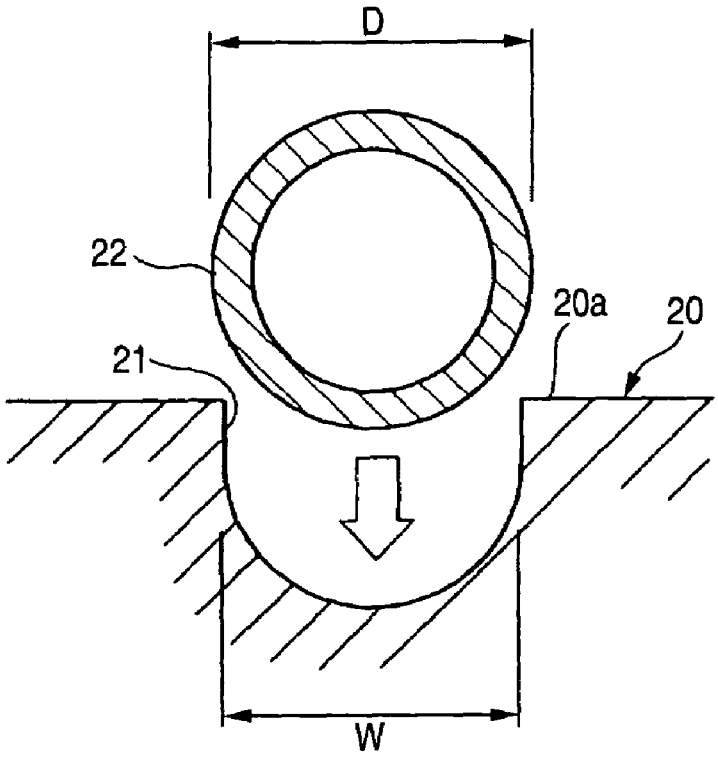
FIG. 4A is a cross-sectional view to show the state before a heat pipe is press fitted into a groove and FIG. 4B is a cross-sectional view to show a heat pipe press fitted into a groove.
Figure 4B:
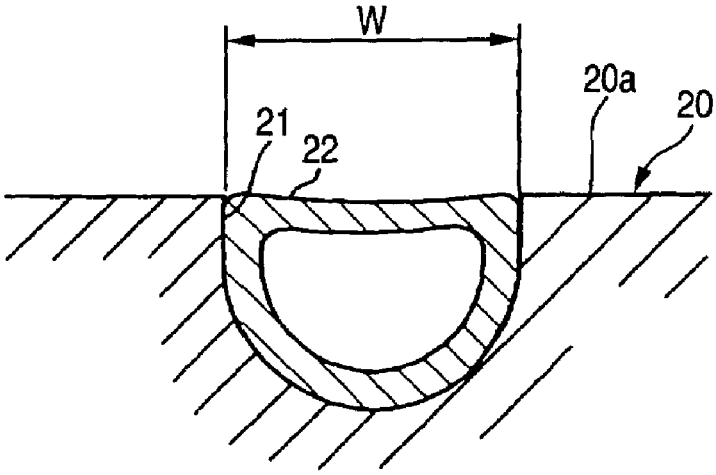

Next, as illustrated in FIG. 3C, the heat pipe 22 is accommodated in the groove 21. In this case, since the outer diameter D of the heat pipe 22 is larger than the width W of the groove 21, the heat pipe 22 does not enter the groove 21 only by placing it on the groove 21. For this reason, the heat pipe 22 is pressed, thereby press fitting into the groove 21. In this way, as illustrated in FIG. 4B, the heat pipe 22 whose outside is made of a copper tube is deformed adaptive to the cross-sectional shape of the groove 21 and accommodated in the groove 21. Thus, as illustrated in FIG. 3D, the heat pipe 22 comes into intimate contact with the internal surface of the groove 21 and is accommodated in the groove 21. At this time, by making the cross-sectional area of the groove 21 approximately equal to that of the heat pipe 22, substantially the whole area of the groove 21 can be filled due to the deformation of the heat pipe 22. According to this construction, an efficiency of heat transfer from the one surface 20*a* to the other surface 20*b* of the guide member 20 is enhanced, whereby the temperature of the guide member 20 can be made uniform by the heat pipe 22.

Figure 3E:
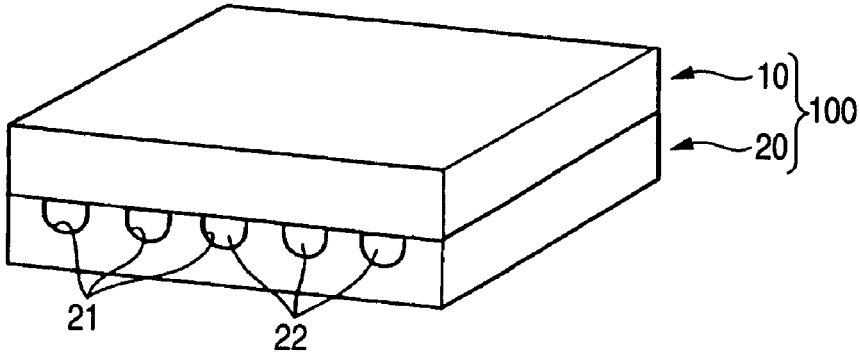

As illustrated in FIG. 3E, the heating member 10 is bonded to the one surface 20*a* of the guide member 20.

Incidentally, in the case where the heating surface 20*b* of the guide member 20 is formed in the curved shape, one surface of the metal plate 23 is previously formed in the curved shape. Also, for example, one illustrated in FIG. 5 can be used as the heating member 10.

FIG. 5 is a partial cross-sectional perspective view of the rubber heater.

In this heating member 10, one prepared by putting a heating element 12 made of, for example, inconel between upper and lower silicone rubbers 11*a*, 11*b* before vulcanization and pressurizing and heating the silicone rubbers 11*a*, 11*b* to vulcanize the silicone rubbers 11*a*, 11*b* can be used.

As described previously, according to the heating plate 100 of this embodiment, the groove 21 is provided on the one surface 20*a* of the guide member 20, and the heat pipe 22 is accommodated in the groove 21. Accordingly, the processing can be easily carried out from the one surface 20*a* of the metal plate 23 as compared with the related-art case where communicating holes are provided from the side surface of the metal plate 23 for the purpose of constructing or inserting heat pipes. Also, since the width of the groove 21 provided in the guide member 20 is shorter than the outer diameter of the heat pipe 22 before the accommodation, when the heat pipe 22 is press fitted and accommodated in the groove 21, the heat pipe 22 is deformed and comes into intimate contact with the internal surface of the groove 21. For this reason, since the heat transfer between the heat pipe 22 and the guide member 20 is efficiently and smoothly carried out, there gives rise to an effect for making the temperature of the guide member 20 uniform as a whole. As a result, it is possible to uniformly heat the heat development recording material 30 regardless of the place and to undergo heat development.

Figure 6:
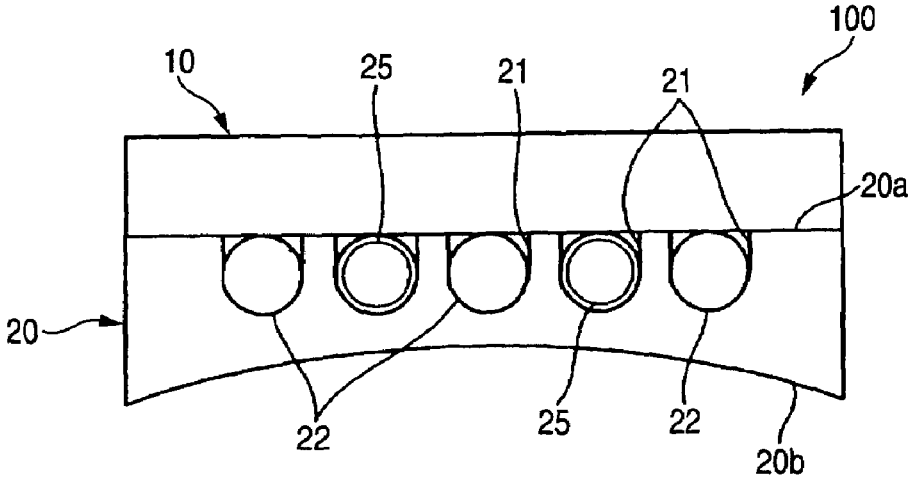
FIG. 6 is a side view to show a modification example of a heating plate.

FIG. 6 is a side view to show a modification example of the heating plate.

In the foregoing respective embodiments, the case where each of the heat pipes 22 is accommodated in each of the grooves 21 has been described. Instead of these embodiments, a copper tube 25 can be accommodated in at least one of the grooves 21 of the guide member 20 in place of the heat pipe 22. In this case, since the heat capacity of the guide member is made small, it is possible to shorten the rise time. Also, it is possible to economically construct the heating plate without using the excessive number of heat pipes 22. Incidentally, although a copper tube is taken as an example in the invention, it is not limited to the copper tube, and a heat-conductive tube made of other kinds of materials may be used as far as it has large heat conductivity.

Also, the cross-sectional shape of the groove 21 is not limited to the U-shape, and a semi-elliptic shape or a rectangular shape can be properly employed.

Next, the second embodiment of the heating plate according to the invention will be described below.

Figure 7:
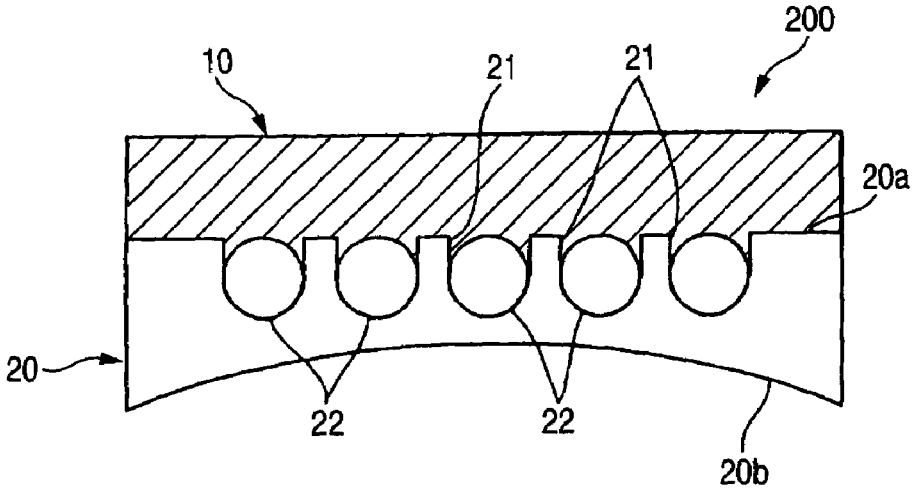
FIG. 7 is a side view of the heating plate of the second embodiment according to the invention.
Figure 8A:
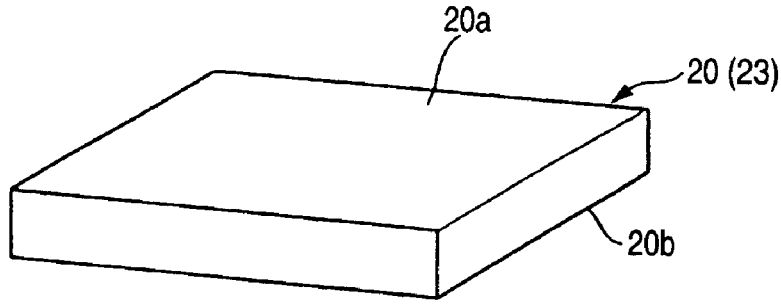
FIGS. 8A to 8E are explanatory views to show the process for producing a heating plate according to the invention.
Figure 8B:
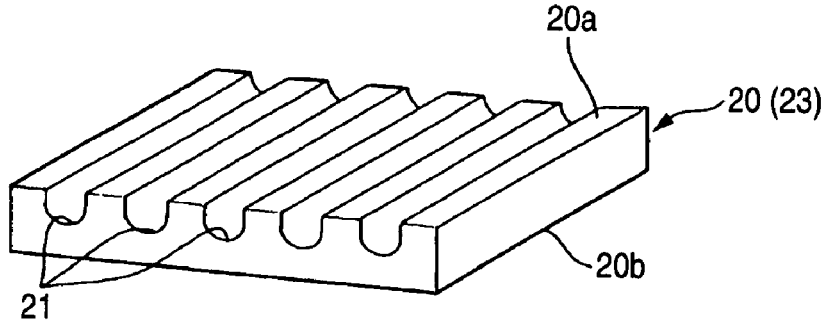

FIG. 7 is a side view to show the second embodiment according to the heating plate and the process for producing the same of the invention; FIG. 8A to FIG. 8E are each an explanatory view to show the process for producing a heating plate according to the invention; and FIG. 9A to FIG. 9C are each a cross-sectional view to show the state in which a rubber heater goes around a heat pipe. Incidentally, common sites to those in the foregoing first embodiment are each given the same symbol, and their overlapping explanations are omitted.

As illustrated in FIG. 7, this embodiment is identical to the foregoing first embodiment in the points that a heating plate 200 is provided with a heating member 10 and a guide member 20; that one surface 20*a* of the guide member 20 is heated by the heating member 10; and that a heat development recording material 30 (see FIG. 2) is heated while making the other surface 20*b* of the guide member 20 work as a heating surface.

In this heating plate 200, a rubber heater 13 as the heating member 10 is welded to the guide member 20 through a vulcanization treatment, and the rubber heater 13 is permeated and welded between plural grooves 21 provided on the one surface 20*a* of the guide member 20 and each of the heat pipes 22 accommodated in each of the grooves 21. The cross-sectional shape of the groove 21 provided on the one surface 20*a* of the guide member 20 is formed such that the groove 21 can easily accommodate the heat pipe 22 therein. For example, the groove 21 can be formed in the U-shape having a width larger than the outer diameter of the heat pipe 22.

The second embodiment of the process for producing a heating plate according to the invention will be described below with reference to FIG. 8A to FIG. 8E.

First of all, the production of the guide member 20 is carried out. As illustrated in FIG. 8A, an aluminum metal plate 23 is prepared; and as illustrated in FIG. 8B, the plural grooves 21 are provided at prescribed intervals on the one surface 20*a* of the metal plate 23. Incidentally, since the cross-sectional shape of the groove 21 is formed such that the heat pipe 22 is accommodated therein and the dimension is not strictly defined, high processing precision is not particularly required. Accordingly, the processing is markedly simplified as compared with the related-art processing of forming communicating holes.

Figure 8C:
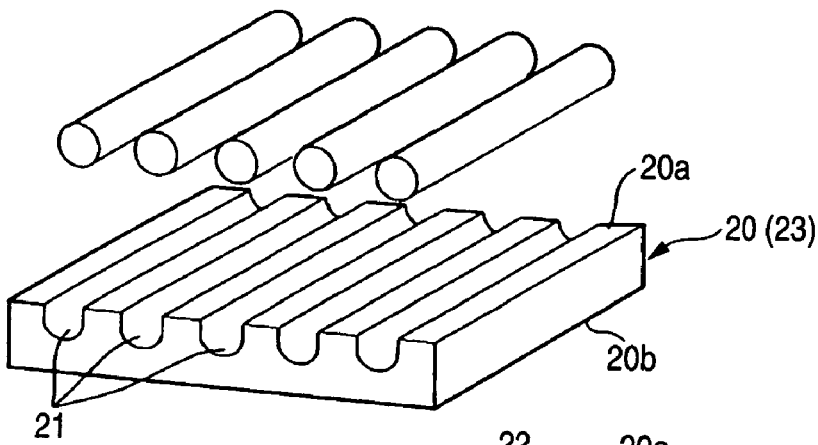
Figure 8D:
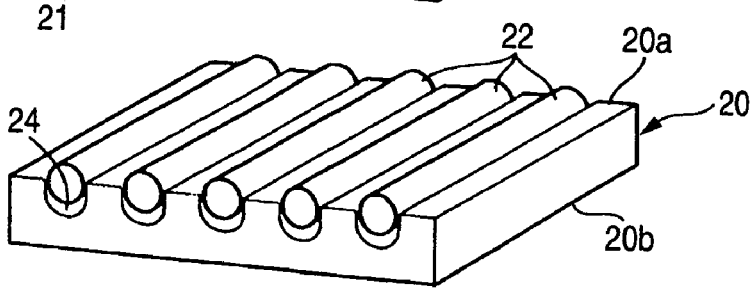
Figure 8E:
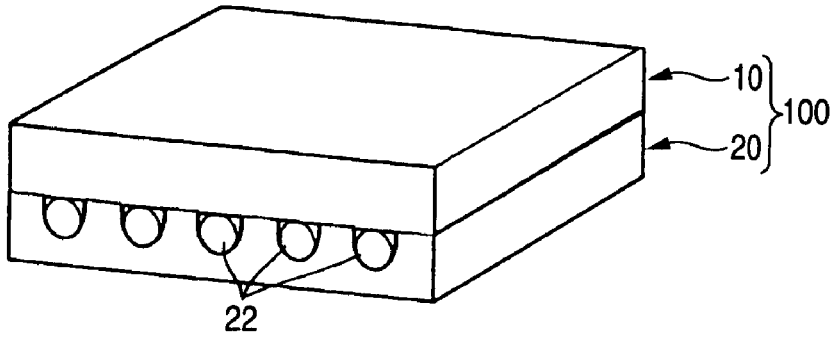
Figure 9A:
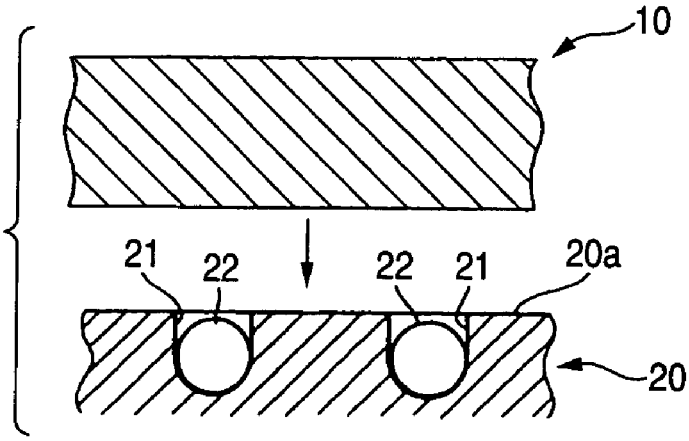
FIGS. 9A to 9C are cross-sectional views to show the state in which a rubber heater goes around a heat pipe.
Figure 9B:
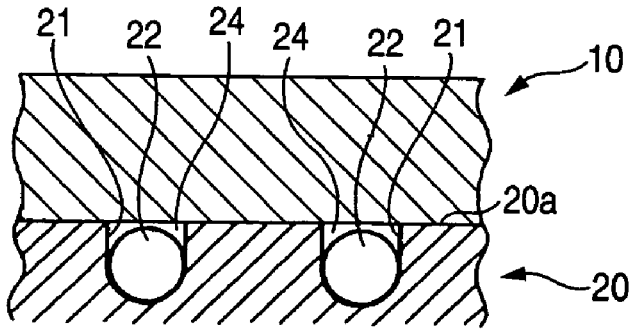
Figure 9C:
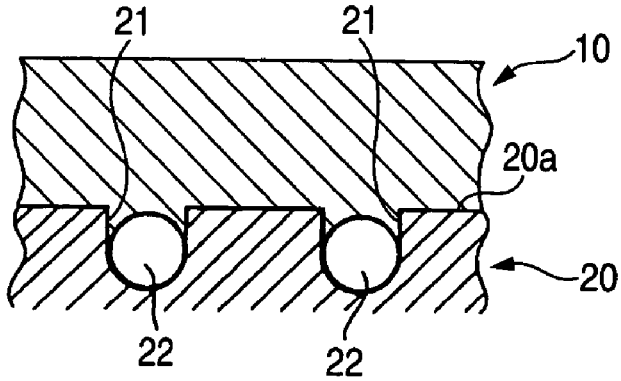

Next, as illustrated in FIG. 8C, when the heat pipe 22 is accommodated in the groove 21, the cross-section of the groove 21 is larger than that of the heat pipe 22. Therefore, as illustrated in FIG. 8D, a gap 24 is generated between the external periphery of the heat pipe 22 and the internal periphery of the groove 21. Finally, as illustrated in FIG. 8E, the rubber heater 13 which is the heating member 10 is bonded onto the one surface 20*a* of the guide member 20 upon pressurization and heating.

The details of the welding step of the rubber heater 13 are shown in FIG. 9A to FIG. 9C. As illustrated in FIG. 9A, the rubber heater before vulcanization is placed above the heat pipe 22 accommodated in the groove 21 of the guide member 20. As illustrated in FIG. 9B, heat (for example, approximately 180° C.) and pressure are applied to silicone rubbers 11*a*, 11*b* having a heating element 12 sandwiched therebetween in this state, thereby vulcanizing the silicone rubbers 11*a*, 11*b*. In this way, at the same time when the rubber heater 13 is formed, as illustrated in FIG. 9C, the silicone rubber 11*b* comes into the internal surface of the groove 21 and the external surface of the heat pipe 22, thereby filling up the gap 24.

In the thus constructed heating plate 200, since the heating member 10 is the rubber heater 13 having the heating element 12 therein, the heating member 10 can be easily brought into intimate contact with the guide member 20, whereby the guide member 20 can be efficiently heated. Also, a bonding step as in the case of bonding using an adhesive is not necessary. Also, since the heat pipe 22 is simultaneously bonded, not only the production step is simplified, but also reliability of the bonding is enhanced. Also, even in the case where the top of the heat pipe 22 accommodated in the groove 21 is protruded from the one surface 20*a* of the guide member 20, the rubber heater 13 is deformed to surely cover the heat pipe 22, whereby it can be stably accommodated in the groove 21. Also, since the processing precision of the groove 21 is not particularly severe, it is possible to design to reduce costs.

Incidentally, a copper tube 25 can be accommodated in at least one of the grooves 21 of the guide member 20 in place of the heat pipe 22 likewise the case described in FIG. 6.

In this way, there can give rise to the same action and effect as those described above.

Also, in accommodating the heat pipe 22 in the groove 21, a high heat conductive substance such as silicone grease and solder may be made to lie between the both contact surfaces. In this way, the gap between the groove 21 and the heat pipe 22 is surely filled up, whereby the heat transfer efficiency can be further enhanced.

Next, one example of the heat development device constructed using the foregoing heating plate 100 (200) will be described below.

Figure 10:
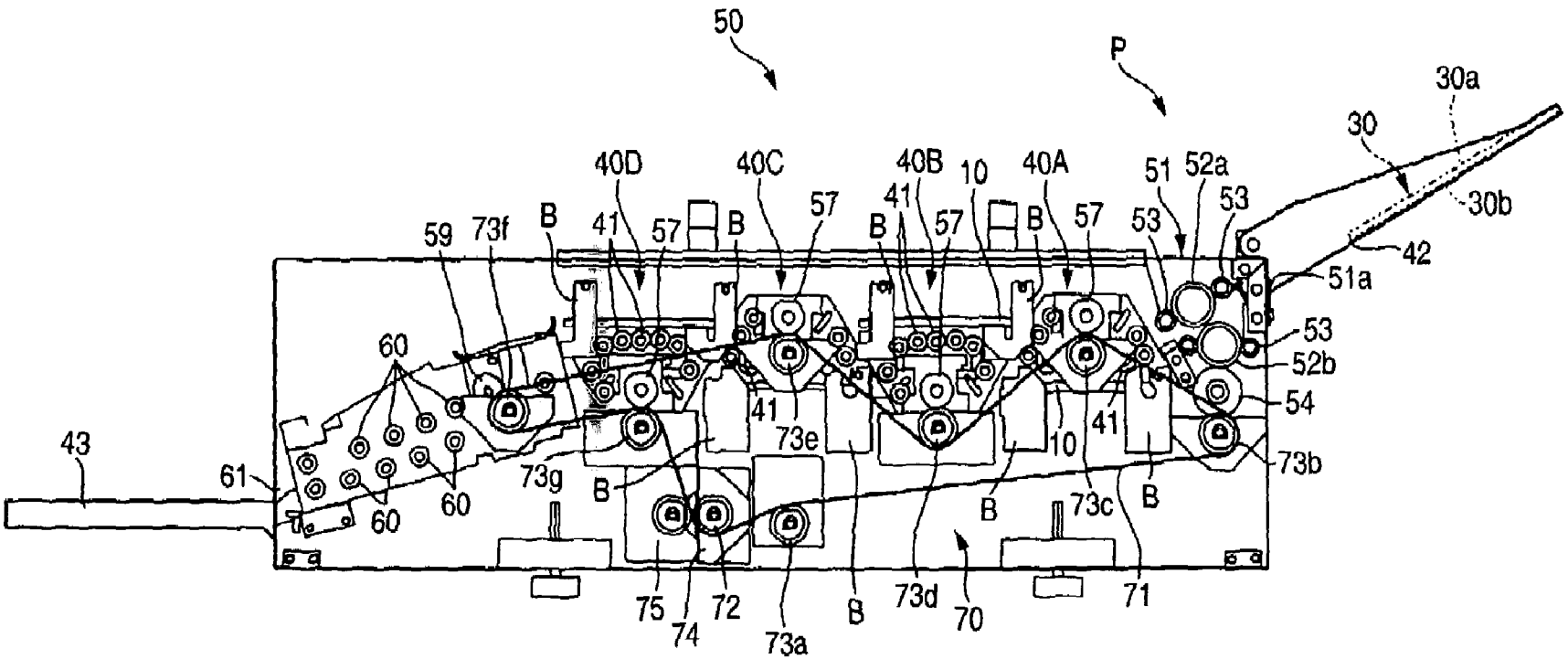
FIG. 10 is a cross-sectional view to show one example of a heat development device to which the heating plate of the invention is applied.
Figure 11:
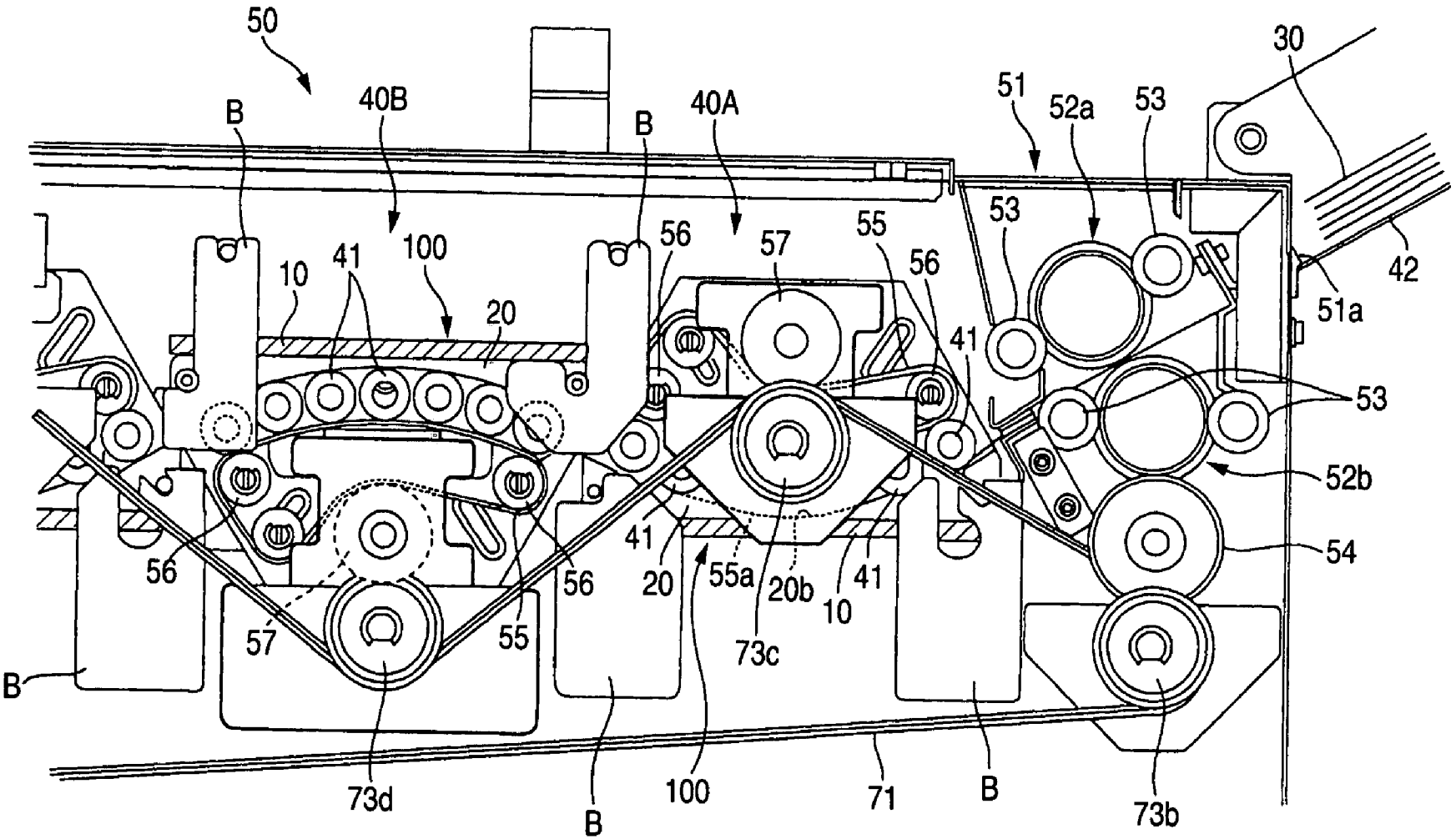
FIG. 11 is an enlarged cross-sectional view of a P portion of FIG. 10.
Figure 12:
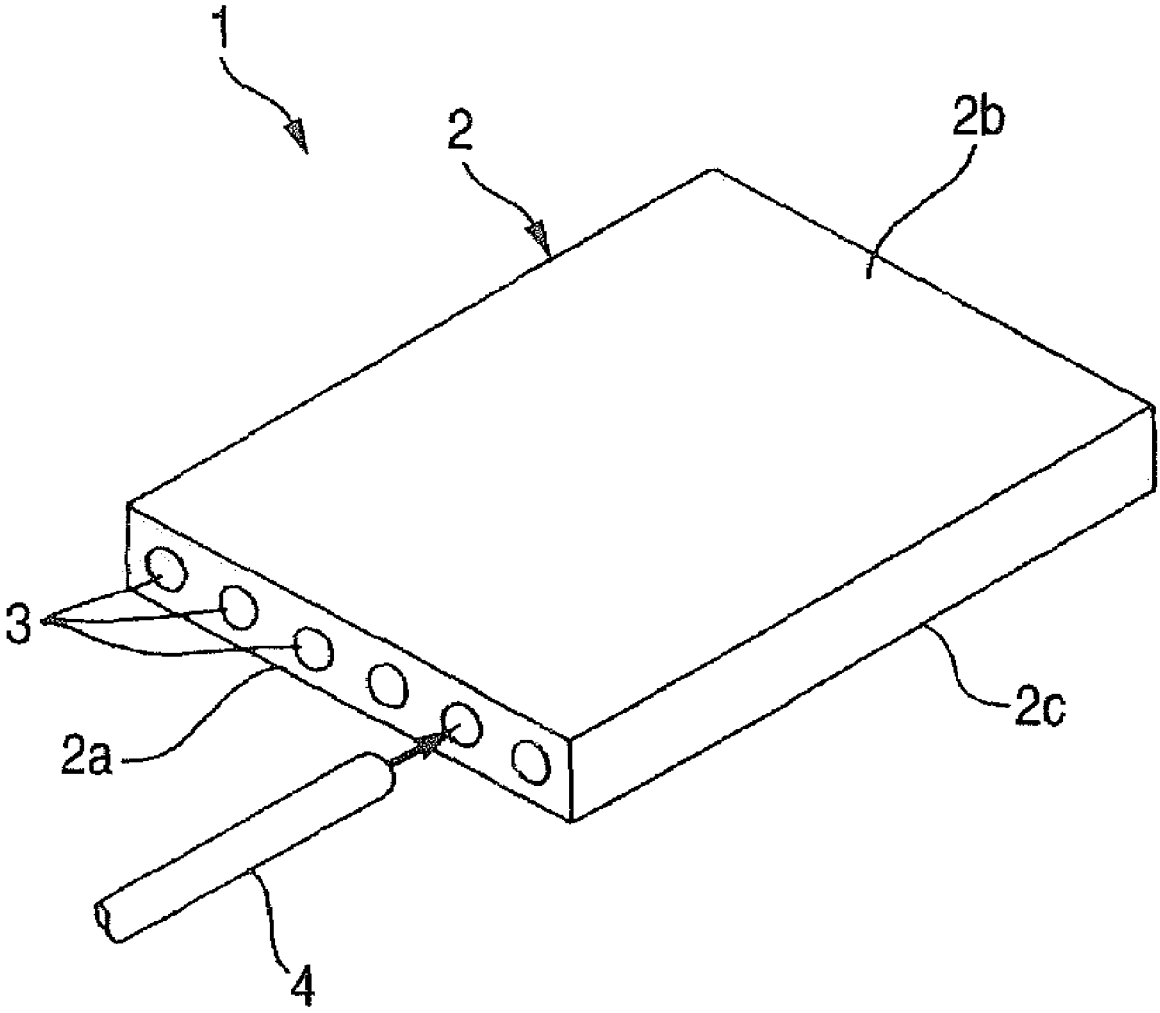
FIG. 12 PRIOR ART
FIG. 12 is an perspective view to show a soaking plate of the related art.

FIG. 10 is a side view of the heat development device; and FIG. 11 is an enlarged cross-sectional view of a P portion of FIG. 10. Incidentally, common sites to those in the foregoing first and second embodiments are each given the same symbol, and their overlapping explanations are omitted. Also, the case of thermally developing a heat development recording material 30 in which an image forming layer is formed on each of the upper and lower surfaces thereof is described herein.

As illustrated in FIG. 10, in this heat development device 50, a feed port 51*a* for feeding every one sheet of the heat development recording material 30 into the device is provided in an upper corner portion of one end of a main body case 51, and a feed tray 42 for feeding the heat development recording material 30 into the feed port 51*a* is provided outside the feed port 51*a*.

A pair of upper and lower adhesive rolls 52*a*, 52*b* are rotatably provided inside the feed port 51*a*. In each of the adhesive rolls 52*a*, 52*b*, an adhesive layer is formed on the peripheral surface thereof and removes dusts, etc. adhered onto the front and rear surfaces of the heat development recording material 30 which has been fed. In each of the adhesive rolls 52*a*, 52*b*, the both ends thereof in the axis direction are rotatably supported by a pair of supporting rollers 53, 53 and supported by the matter that both the adhesive rolls 52*a*, 52*b* are mutually pressed and supported by the supporting rollers 53, 53. The lower adhesive roll 52*b* is rotated and driven via a transfer pulley 54 to be rotated and driven by a drive section 70 as described later in detail. The upper adhesive roll 52*a* is rotated and driven by the lower adhesive roll 52*b*.

In the downstream side in the delivery direction of the adhesive rolls 52*a*, 52*b* (left side in FIG. 10), the first to fourth heating sections 40A, 40B, 40C and 40D (four in total) are alternately aligned upward and downward against a delivery passage. That is, in the first heating section 40A, a heating member 10 is provided in the lower side, and a guide member 20 is provided in the upper side of the heating member 10 (see FIG. 11); and in the second heating section 40B, the heating section 40A is reversed up and down, and the heating member 10 is provided in the upper side, whereas the guide member 20 is provided in the lower side of the heating member 10. Also, the third heating section 40C is aligned in the same direction as in the first heating section 40A; and the fourth heating section 4D is aligned in the same direction as in the second heating section 4B. Each heating section 40 is fixed to the main body case 51 by a bracket B.

In each heating section 40, as explained in FIG. 2, plural press rolls 41 are aligned along a heating surface 20*b* of the guide member 20, and the respective press rolls 41 are rotatably provided in the state such that they do not come into contact with each other. Also, a slight gap is ensured between the press roll 41 and the heating surface 20*b* such that the press roll 41 does not come into contact with the heating surface 20*b*, and the press rolls 41 are energized in the direction of the heating surface 20*b* by a non-illustrated energizing unit such as a spring. In this way, the heat development recording material 30 which has been fed is delivered in the downstream side in the delivery direction while pressing onto the heating surface 20*b*.

Also, a belt 55 for rotating and driving the press rolls 41 is suspended by plural free rolls 56 in the opposite side of the press rolls 41 to the guide member 20. For the purpose of bringing the belt 55 into stable contact with the respective press rolls 41 aligned in the curved shape along the heating surface 20*b*, a belt guide 55*a* having a curved guide surface is provided inside the belt 55. On the other hand, drive pulleys 57 for running and driving the belt 55 are provided outside the belt 55. Incidentally, the drive pulleys 57 are rotated and driven by the drive section 70 as described later.

As illustrated in FIG. 10, a delivery roll 59 for delivering the heat development recording material 30 having been thermally developed upon heating into a cooling section as a subsequent stage is provided in the downstream side in the delivery direction of the fourth heating section 40D. This delivery roller 59 is also rotated and driven by the drive section 70 as described later. Further, free rolls 60 aligned up and down in the staggered state, which discharge the thermally developed heat development recording material 30 while cooling, are provided in the downstream side in the delivery direction of the delivery roll 59 toward a discharge port 61. A discharge tray 43 for receiving the heat development recording material 30 which has been thermally developed and discharged is installed outside the main body case 51 corresponding to the discharge port 61.

As illustrated in FIGS. 10 and 11, one drive belt 71 for running substantially the whole of the principal section of the heat development device 50 is provided in the drive section 70. The drive belt 71 is supported by a drive pulley 72 for belt driving and plural driven pulleys 73*a* to 73*g* in the state such that it can run. The drive pulley 72 is connected to a drive motor 75 via reduction gears 74. Accordingly, by rotating the drive motor 75, the drive belt 71 is run by the drive pulley 72, and the respective driven pulleys 73*a* to 73*g* are rotated by the drive belt 71.

Accordingly, in the heat development device 50, the heat development recording material 30 which has been fed into the feed port 51*a* from the feed tray 42 is subjected to removal of dusts, etc. on the surface by the adhesive rolls 52*a*, 52*b* and delivered into the first heating section 40A by the rotation of the adhesive roll 52*b*. In the first heating section 40A, the lower surface 30*b* of the heat development recording material 30 is pressed onto the heating surface 20*b* of the guide member 20 by the press rolls 41, heated and thermally developed. The heat development recording material 30 is delivered into the second heating section 40B by the press rolls 41 and developed upon heating of the upper surface 30*a*. Subsequently, in the third heating section 40C, the lower surface 30*b* is again heated, and in the fourth heating section 40D, the upper surface 30*a* is again heated, whereby the both surfaces of the heat development recording material 30 are alternately heated. The heat development recording material 30 after completion of the heat development is delivered into a cooling section by the delivery roll 59, and after cooling to such extent that there is no problem even by touching by fingers, is discharged onto the discharge tray 43 from the discharge port 61.

Incidentally, in the heat development device 50 using the heating plate according to the invention, the case of carrying out the heat development processing of the heat development recording material 30 while delivering has been described. However, the invention is not limited thereto, but the heat development recording material 30 may proceed with heat development in the state of stopping the delivery while bringing the heat development recording material 30 into contact with the heating plate 100 (200). In this case, for example, in the heat development device 50 as illustrated in FIG. 10, by alternately reversing the up and down direction in the heating sections 40A, 40B, 40C, 40D, it is possible to shorten the delivery passage from four to two or three, whereby it becomes possible to design to reduce the size of the heat development device 50.

What is claimed is:

1. A heating plate comprising:

a heating member; and a guide member, one surface of which comes into contact with the heating member and other surface of which comes into contact with a body to be heated to heat the body to be heated, wherein the one surface of the guide member has plural grooves with intervals, with and a heat pipe is accommodated in the groove, and wherein the heating member is a rubber heater having a heating element inside a silicone rubber.

2. A heating plate comprising:

a heating member; and a guide member, into contact with the heating member and other surface of which comes into contact with a body to be heated to heat the body to be heated, wherein the one surface of the guide member has plural grooves with intervals, and a heat pipe is accommodated in the groove, wherein a heat-conductive tube is accommodated in at least one of the grooves of the guide member in place of the heat pipe, and wherein the heat conductive tube is a copper tube.

3. A heating plate comprising:

a heating member; and a guide member, one surface of which comes into contact with the heating member and other surface of which comes into contact with a body to be heated to heat the body to be heated, wherein the one surface of the guide member has plural grooves with intervals, and a heat pipe is accommodated in the groove, and wherein the other surface of the guide member is curved in an arc shape so as to surely come into contact with the body to be heated.

4. A process for producing a heating plate comprising: a heating member; and a guide member, one surface of which comes into contact with the heating member and other surface of which comes into contact with a body to be heated to heat the body to be heated, which comprises:

forming plural grooves on the one surface of the guide member; and press fitting a heat pipe having a diameter larger than a width of the groove into the groove, thereby bringing an external periphery of the heat pipe into intimate contact with a surface of the groove.

5. A process for producing a heating plate comprising: a heating member; and a guide member, one surface of which comes into contact with the heating member and other surface of which comes into contact with a body to be heated to heat the body to be heated, which comprises forming plural grooves on the one surface of the guide member;

accommodating a heat pipe in the groove;

placing a silicone rubber before vulcanization having a heating element inside the silicone rubber on the one surface of the guide member; and vulcanizing for welding the silicone rubber while pressing it onto the guide member.

* * * * *